US006606946B2

(12) United States Patent
Koch

(10) Patent No.: US 6,606,946 B2
(45) Date of Patent: Aug. 19, 2003

(54) SHEET-FED OFFSET PRINTING PROCESS AND SHEET-FED OFFSET PRINTING MACHINE

(75) Inventor: Hans-Peter Koch, Hamburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/863,923

(22) Filed: May 23, 2001

(65) Prior Publication Data

US 2001/0050012 A1 Dec. 13, 2001

Related U.S. Application Data

(63) Continuation of application No. PCT/EP99/08552, filed on Nov. 8, 1999.

(30) Foreign Application Priority Data

Nov. 16, 1998 (DE) ..... 198 52 714

(51) Int. Cl.[7] ..... B41F 35/00

(52) U.S. Cl. ..... 101/423; 101/424.1; 271/195; 271/204; 271/211; 118/312; 118/326

(58) Field of Search ..... 101/423, 425, 101/424.1, 424.2; 271/183, 195, 211, 204; 118/312, 326

(56) References Cited

U.S. PATENT DOCUMENTS 3,434,416 A * 3/1969 Testone ..... 101/416.1
3,556,519 A * 1/1971 Keller et al. ..... 271/177
3,695,606 A * 10/1972 Wirz ..... 271/12
3,819,032 A 6/1974 Preuss et al. ..... 198/180
4,052,936 A * 10/1977 Pabodie ..... 101/295
5,265,536 A 11/1993 Millard ..... 101/424.1
5,634,401 A 6/1997 Weaver ..... 101/416.1
6,129,020 A * 10/2000 Speck ..... 101/425
6,273,417 B1 * 8/2001 Berlingen et al. ..... 271/183

OTHER PUBLICATIONS

Patent Abstracts of Japan No. 09–057945 (Kenichi), dated Mar. 4, 1997.
Patent Abstracts of Japan No. 04–043038 (Yoshifumi), dated Feb. 13, 1992.

* cited by examiner

*Primary Examiner*—Andrew H. Hirshfeld
*Assistant Examiner*—Dave A. Ghatt
(74) *Attorney, Agent, or Firm*—Laurence A. Greenberg; Werner H. Stemer; Ralph E. Locher

(57) ABSTRACT

A sheet offset printing method and a sheet offset printing press includes altering flow relationships in an interior of a housing of a sheet delivery of a sheet-fed printing machine to prevent uncontrolled spread of powder in the housing by extracting powder-laden air from the housing and/or feeding air into the housing from outside at a point along a return belt of a sheet conveying device. Air currents are channeled inside the housing by feeding air not laden with powder into the housing and/or leading the air into an air flow path along the return belt downstream of the point with respect to a return belt motion direction to transport the unladen air toward a printing unit by a drag effect of the return belt and/or impeding/blocking a supply of powder-charged air from around a conveyor belt of the sheet-conveyor or a powder-scattering device into a flow path along the return belt.

46 Claims, 6 Drawing Sheets

SHEET-FED OFFSET PRINTING PROCESS AND SHEET-FED OFFSET PRINTING MACHINE

CROSS-REFERENCE TO RELATED APPLICATION

This application is a continuation of copending International Application No. PCT/EP99/08552, filed Nov. 8, 1999, which designated the United States.

BACKGROUND OF THE INVENTION

FIELD OF THE INVENTION

The invention lies in the field of printing. The invention relates to a sheet-fed offset printing process, in which flow relationships in the interior of a housing of a sheet delivery of a sheet-fed offset printing machine are altered to prevent the uncontrolled spread of powder in the housing. Powder-laden air is extracted from the housing on at least one point along an empty run of a sheet conveying device and/or air is fed into the housing from outside. The invention relates further to a sheet-fed offset printing machine having a sheet delivery and a powdering device disposed in a housing of the sheet delivery to powder the printed sheets. The machine has air feed devices to feed air into the housing from outside and/or air extraction devices to extract powder-laden air from the housing. The devices are disposed on at least one point along an empty run of a sheet conveying device to prevent the uncontrolled spread of powder in the housing by altering the flow relationships inside the housing.

Printing processes and printing machines are described, for example, in my German patent application DE 198 01 949.1, from which priority is claimed in my U.S. patent application Ser. No. 09/619,975 through PCT/EP99/00271. U.S. patent application Ser. No. 09/619,975 is hereby incorporated herein by reference. The application proposes to feed air deliberately into the interior of the housing of a sheet delivery of a sheet-fed offset printing machine to prevent the uncontrolled spread of powder in the interior of the delivery or into the surroundings by altering the flow relationships. With a view to limiting the spread of powder and reducing the necessary amounts of powder, particularly good results are achieved if the air was fed into the housing from above through the empty run in a region located downstream of a powdering device in the direction of motion of a conveying run of the sheet delivery, and/or at the same time powder-laden air was extracted from such region.

In the sheet deliveries of conventional offset printing machines, air turbulence occurs to a great extent. Various effects cause the air turbulence. For example, underneath and above the conveying run and the empty run of the sheet delivery, the suction action of the moving sheet grippers and chains entrains air in the direction of motion of the respective run. Also, printed sheets carried along by the conveying run flutter or, when being deflected from an oblique angle into the horizontal, flip up at their rear edge (also known as the lashing or flag effect). Further, air is blown from below against the sheet from the sheet guide plate to guide the sheet over the guide plate without contact, but some of the air flows upward between the adjacent sheets and laterally past the sheets.

As a result of the air turbulence, a large part of the powder emerging from the powdering device is swirled and entrained by the air. Thus, it does not pass as desired onto the printed surface of the sheets directly underneath the powdering device. Instead, the powder is distributed over the entire interior of the sheet delivery by the air flows, in particular, those along the two runs of the sheet delivery. The distribution not only leads to increased wear of moving parts and relatively long down times for cleaning the sheet delivery, it also aggravates operating personnel because the swirled powder emerges into the surroundings through all the openings in the sheet delivery, in particular, through the sheet outlet opening and air outlet grating on the top of the housing.

In addition, as a result of the powder being transported back as far as the impression cylinder of the last printing unit or as far as the delivery drum of the printing machine, powder gets onto the still moist surface of the printing material or the printing ink directly after the printing material has emerged from the printing machine. The powder, which usually includes starch, picks up part of the liquid present there, for example, surface water originating from the feed of damping solution, and possibly also relatively highly volatile or low-viscosity constituents of the printing ink. Because the liquid picked up by the powder is not absorbed into the printing material, or is absorbed considerably more slowly, and does not participate in the chemical crosslinking process of the printing ink either, the moisture content of the sheets is higher when they are deposited on the sheet stack. Such moisture delays the drying, and there is an increase in the time intervals needed before the further processing of the printed products. Next, in the event shear is exerted on the moist printing ink, the liquid picked up by the powder can also have a decreasing effect on the shear strength of the printing ink if deposited powder particles are detached. Such detachment can result in the exposure of incompletely dried point-like surface areas of the printing ink located underneath the detached particles.

The adverse affect is counteracted, according to my co-pending U.S. patent application Ser. No. 09/619,975, by feeding air into the housing of the sheet delivery from above through the empty run. The air feed firstly prevents powder from being transported in the direction of the printing machine by the empty run and by air flows along the empty run and, secondly, in conjunction with one or more brush strips, the empty run being freed from adhering powder. If some of the air fed in, after passing through the empty run, is deflected in the direction of the printing machine, the deflected air also prevents powder in the region of the powdering device from getting as far as the empty run of the sheet delivery and from being transported by the empty run in the direction of the printing machine. As a result, at least in the case of sheet-fed offset printing machines with short sheet deliveries, the region of the sheet delivery located directly downstream of the delivery drum could be kept virtually powder-free, a status that not only reduces wear and powder emissions into the surroundings but, surprisingly, could also accelerate the drying of the printing material and the printing ink, probably because of the action mechanism described in the preceding paragraph.

The amount of excess powder emerging into the surroundings of the sheet delivery could be reduced once more by extracting part of the air fed in and of further powder-laden air from the interior of the housing of the sheet delivery in the direction of movement of the conveying run downstream of the powdering device, as proposed by my co-pending U.S. patent application Ser. No. 09/619,975.

Trials and experience with processes and devices for keeping clean or cleaning a sheet delivery of a sheet-fed offset printing machine of excess powder according to my U.S. patent application Ser. No. 09/619,975 have shown, however, that further improvements are possible with regard to reducing the powder emissions inside and outside the sheet delivery.

SUMMARY OF THE INVENTION

It is accordingly an object of the invention to provide a sheet-fed offset printing process and a sheet-fed offset printing machine that overcomes the hereinafore-mentioned disadvantages of the heretofore-known devices and methods of this general type and that reduces the spread of powder.

With the foregoing and other objects in view, there is provided, in accordance with the invention, a sheet-fed offset printing process, including the steps of altering flow relationships in an interior of a housing of a sheet delivery of a sheet-fed printing machine to prevent uncontrolled spread of powder in the housing by at least one of extracting powder-laden air from the housing on at least one point along an empty run of a sheet conveying device; and feeding air into the housing from outside the housing on at least one point along the empty run, channeling air flows inside the housing by feeding air not laden with powder into the housing and leading the air not laden with powder into an air flow path along the empty run downstream of the at least one point with respect to a direction of motion of the empty run to transport the air not laden with powder in a direction toward a printing unit of the printing machine by at least one of a suction effect of the empty run, and at least impeding an inflow of powder-laden air from a region of at least one of a conveying run of the sheet conveying device and a powdering device into the flow path along the empty run.

The channeling or control of air flows within the housing according to the invention makes it possible to prevent the air flows (which to some extent are only produced by altering the flow relationships in the housing as a result of feeding and/or extracting air along the empty run of the sheet conveying device) from transporting swirled powder as far as the impression cylinder of the last printing unit or as far as the delivery drum of the printing machine.

The invention is based on the finding that the principle transport paths for swirled powder in the housing of the sheet delivery run along the sheet conveying device because of the suction action of the sheet conveying device, the air flow along the empty run transporting powder in the direction of the printing machine. As a result of feeding and/or extracting air along the empty run, as described in my co-pending U.S. patent application Ser. No. 09/619,975, a large part of the entrained powder can be eliminated, in particular, if, according to a preferred configuration of the invention, the feeding and/or extraction of air produces an air flow that passes through the empty run transversely with respect to its direction of movement. Such a configuration has the effect of interrupting the powder-laden air flow along the empty run. However, a vacuum is produced downstream of the interruption point, which can lead to powder-laden air being extracted from other regions of the sheet delivery. In addition, between the opposed air flows along the empty run and the conveying run of the sheet conveying device, transverse flows are formed, which can likewise result in transporting swirled powder from the region of the powdering device and the conveying run into the flow path of the empty run and, from there, to the impression cylinder of the last printing unit or to the delivery drum of the printing machine.

In order to prevent such a result, the channeling of the air flows inside the housing according to the invention, firstly in a direction of motion of the empty run downstream of the point at which the air is extracted and/or fed in, air not laden with powder is fed into the housing to carry away powder-laden air entrained along the empty run by the suction action of the empty run from the flow path of the empty run.

In accordance with another mode of the invention, the air not laden with powder is fed in from above the empty run into the air flow path along the empty run.

The preferably pre-cleaned air replaces the powder-laden air carried away and prevents powder-laden air subsequently flowing from other regions of the sheet delivery because of a vacuum, which can occur if the flow path along the empty run is interrupted. Second, with the channeling of the air flows according to the invention, the inflow of powder-laden air from the region of a powdering device or a conveying run of the sheet conveying device into the flow path along the empty run can additionally or alternatively be impeded or blocked by mechanical or fluidic devices to reduce the entry of powder from other regions of the sheet delivery or to prevent it completely.

The air not laden with powder can be fed in by air either being blown into the housing from outside and/or by being drawn in from outside by a vacuum generated in the housing as a result of interrupting the powder-laden air flow along the empty run. The configuration has a first advantage that the amount of air blown to interrupt the air flow and/or for flushing purposes can be kept small, and a second advantage that powder particles cleaned off and possibly contained in the air are prevented from being transported in the direction of the printing machine.

In accordance with a further mode of the invention, the amount of air fed into the housing is controlled by at least one of a printing speed of the printing machine and a running speed of the sheet conveying device.

In accordance with an added mode of the invention, at least some of the air is fed into the housing at atmospheric pressure and the air is drawn into the housing with a vacuum generated in the housing. Preferably, the air from an air reservoir is disposed on a top side of the housing.

The extraction of air is carried out in the simplest case through air slots or ventilation grilles in the top of the housing, through which air emerges from the interior of the sheet delivery in conventional printing machines. The air blown in and/or extracted is deflected in the direction of the printing machine as it enters the housing and then (as does the powder-laden air in conventional sheet deliveries) flows along the empty run of the sheet conveying device, as a result of the suction of the sheet conveying device, as far as the delivery drum of the printing machine. Because the housing of the sheet delivery is closed in the region, the air is deflected there together with the sheet conveying device and flows in the direction of the powdering apparatus again, underneath and above the sheets transported by its conveying run. The air flow forms an air cushion above and below the freshly printed sheets which, if necessary, can be somewhat amplified on the underside by feeding air through the sheet guide plate, and ensures an extremely quiet run of the sheets.

The virtually complete absence of powder in the air cushion, that is to say, in the vicinity of a portion of the delivery run of the sheet conveying device located between the printing machine and the powdering apparatus, has the effect of permitting powder only to get to the surface of the moist printing material and the moist printing ink when the latter has already been pre-dried somewhat as a result of the absorption of water and liquid binder constituents of the printing ink. Thus, less liquid can be picked up or bound by the powder. In addition, the powder does not remain stuck to a pre-dried surface of the printing ink, which, in conventional printing processes without additional UV or IR drying, would often lead to losses in terms of quality, in particular, on highly glossy prints.

Quieting the sheet run and reducing the amount of air that has to be blown in from below through the sheet guide plate in turn results in a reduction of the air turbulence in the region of the powdering apparatus, so that the powder is swirled less there and, therefore, gets to the surface of the sheet.

In accordance with an additional feature of the invention, the inflow of powder-laden air from the region of at least one of the conveying run and the powdering device into a flow path of the empty run is blocked by deflecting at least some of the air fed in through the air flow path along the empty run in a downward direction past a side of the powdering device facing the printing machine towards sheets transported by the conveying run past the powdering device.

In accordance with yet another mode of the invention, cleaned surrounding air is fed into the housing of the sheet delivery.

In accordance with yet a further mode of the invention, the air flow path running along the empty run of the sheet conveying device in the direction toward the printing unit is interrupted by at least one of extracting the powder-laden air and feeding air into the housing from outside on at least one point between a free end of the sheet delivery and the printing unit. Preferably, the air flow path is interrupted by at least one of at least one row of brushes, and air flowing transversely with respect to the direction of motion of the empty run.

In accordance with yet an added mode of the invention, at least one of the powder-laden air and the air not laden with powder fed into the housing from outside is extracted in a horizontal portion at a top side of the sheet delivery.

In accordance with yet an additional feature of the invention, the inflow of powder-laden air is blocked from the region of at least one of the conveying run of the sheet conveying device and the powdering device into a movement path of the empty run with a dividing wall disposed between the empty run and the conveying run.

A mechanical device or means for blocking an inflow of powder-laden air include, in particular, a dividing wall that is disposed between the empty run and the conveying run and which expediently extends over the entire width of the sheet delivery and at least over part of the length of the sheet delivery, preferably beginning at the place where the air is extracted and/or fed in along the empty run or the powder-laden air flow is interrupted. The wall then runs into the vicinity of the delivery drum of the printing machine.

Fluidic devices or means for impeding an inflow of powder-laden air into the flow path along the empty run include, in particular, extracting powder-laden air, feeding in air not laden with powder or generating targeted air flows which prevent the entry of powder-laden air into the flow path of the empty run.

With the objects of the invention in view, there is also provided a sheet-fed offset printing machine for printing sheets, including at least one printing unit, a sheet conveying device having an empty run and a conveying run, the empty run having a motion direction, the sheet conveying device connected to the at least one printing unit, a sheet delivery having a housing defining an interior, the sheet delivery connected to the sheet conveying device, a powdering device disposed in the housing for powdering printed sheets, at least one of air feed devices feeding air into the housing from outside the housing and disposed on at least one point along the empty run to prevent an uncontrolled spread of powder in the housing by altering flow relationships inside the housing, and air extraction devices for extracting powder-laden air from the housing and disposed on at least one point along the empty run to prevent an uncontrolled spread of powder in the housing by altering flow relationships inside the housing, and channeling devices at least one of leading air not laden with powder, fed into the interior of the housing downstream of the at least one of the air extraction devices and the air feed devices in the motion direction, into an air flow path along the empty run to transport the air not laden with powder in a direction of the at least one printing unit by suction, and at least impeding an inflow of powder-laden air from a region of at least one of the conveying run and the powdering device into the air flow path along the empty run.

In accordance with again another feature of the invention, the channeling devices include at least one air opening in the housing and/or at least one air reservoir communicating with the interior of the housing.

In accordance with again a further feature of the invention, the air opening and/or air reservoir opens into the housing in a vicinity of the empty run and/or communicates with the interior of the housing.

In accordance with again an added feature of the invention, the air opening and/or air reservoir is disposed on the top side of the housing above the empty run.

In accordance with again an additional feature of the invention, there is provided a delivery drum connected to the sheet conveying device. The air opening and/or air reservoir is disposed between the delivery drum and the air extraction devices and/or the air feed devices.

In accordance with still another feature of the invention, powder-laden air is extracted in the vicinity of the powdering apparatus, preferably at the rear edge (facing the printing machine) of an air extraction and deflection trough used for air extraction and air feed. The configuration prevents the undesired swirling of powder away from the powdering apparatus as a result of air turbulence in the vicinity of the latter and, at the same time, deflects part of the fresh air fed into the housing of the delivery downward in the direction of the printed sheets after passing through the empty run in the region of the powdering apparatus. Above the powdering apparatus, an air diverter can expediently be disposed, which deflects some of the air fed in downward past the front side of the powdering apparatus, on the delivery side, and the rear side of the powdering apparatus, on the printing-machine side. The partial flow deflected toward the front side is preferably part of the fresh air used to interrupt the air flow and blown in from above through the empty run, while the partial flow deflected toward the rear side is part of the air drawn into the housing of the sheet delivery from outside downstream of the interruption point.

In accordance with still a further feature of the invention, the powdering device has a side facing the at least one printing unit and another side facing away from the at least one printing unit, and an air diverter is disposed under the at least one air opening or air reservoir dividing air fed into the housing from outside the housing into two partial-flows, a first of the two partial-flows directed along the side of the powdering device facing the at least one printing unit and a second of the two partial-flows directed along the another side facing away from the at least one printing unit in a direction of sheets passing underneath the powdering device.

In accordance with still an added feature of the invention, an amount of air fed into the housing is to be controlled by altering one of a printing speed of the printing machine and a running speed of the sheet conveying device.

In accordance with still an additional feature of the invention, there are also provided air cleaning devices for cleaning air fed into the housing.

In accordance with another feature of the invention, the channeling devices include a dividing wall disposed over a part of the length of the sheet delivery between the empty run and the conveying run.

In accordance with a further feature of the invention, the dividing wall extends into a vicinity of the at least one printing unit.

In accordance with an added feature of the invention, the dividing wall extends from the air feed devices and/or the air extraction devices into a vicinity of the at least one printing unit.

In accordance with an additional feature of the invention, the sheet delivery has an upper horizontal portion; and some of the air feed devices and/or the air extraction devices are disposed in the upper horizontal portion.

In accordance with yet another feature of the invention, the air feed devices and/or the air extraction devices produce an air flow passing through the empty run transversely with respect to the motion direction of the empty run to interrupt a powder-laden air flow running along the empty run in a direction towards the at least one printing unit.

In accordance with yet a further feature of the invention, there is provided at least one brush configuration at least partly blocking the air flow path along the empty run.

As a result of the above measures for preventing the spread of powder inside the housing of the sheet delivery, it is additionally possible for the powder consumption to be reduced to an extreme extent, that is to say, down to about 10% of the amounts previously needed. The reduction first results because the powder substantially only arrives where it is needed, namely on the surface of the sheets, and also results due to the fact that there is considerably less powder needed to prevent set-off the sheets because of the previously effected superficial drying of the printing ink and of the printing material. Lower powder consumption at the same time also means lower powder emissions into the surroundings of the sheet delivery, so that the powder emission problem can be largely eliminated.

In the region of the air outlet opening, further air extraction devices can additionally be provided. These devices can be used to extract powder between the edges of the sheet outlet opening and the edges of the printed sheets before the powder is blown downward through the sheet outlet opening into the surroundings of the sheet delivery by the delivery fans. Such an addition achieves a further reduction in the powder emissions into the surroundings.

In long sheet deliveries, in particular, in deliveries possibly fitted with IR dryers or other drying devices, it may be preferable to interrupt the air flow several times by air extractions, air feeds, and/or brush configurations and in each case then to feed air not laden with powder into the flow path of the empty run to ensure that the spread of powder is prevented and the clean air fed in gets as far as the printing machine. For such a purpose, it is expediently possible for substantially the same devices to be used as the first devices that are used to interrupt the air flow and to feed in air not laden with powder. The devices are expediently disposed in the upper horizontal portion of the sheet delivery. The devices preferably include a nozzle box, possibly fitted with brushes, disposed above the empty run, from which clean air is blown downward in the direction of the empty run, an air extraction and deflection trough that is disposed underneath the nozzle box in the interspace between the empty run and the conveying run and possibly fitted with brushes and that, in each case, extracts some of the air or deflects it in the direction of the printing machine, and an air reservoir that is disposed downstream of the nozzle box and the trough in the running direction of the empty run, and from which the vacuum generated draws clean air into the housing of the sheet delivery through air openings.

Depending on the length and configuration of the sheet delivery, it may be sufficient, instead of one of the aforementioned devices, that is to say, nozzle box, trough, and air reservoir, to provide only an air reservoir on the top of the housing. Thus, if required, further air can be drawn into the housing of the sheet delivery from outside by the suction of the empty run.

In accordance with a concomitant feature of the invention, air fed in through the air opening and/or air reservoir is at atmospheric pressure.

The air reservoir can be kept under a slight positive pressure, so that the air is always fed into the interior of the housing of the sheet delivery. However, the air in the interior of the air reservoir is preferably under atmospheric pressure. According to a further preferred configuration or alternative of the invention, simple control of the feed of air as a function of the printing speed is made possible because higher printing speeds necessitate higher running speeds of the sheet delivery, which, in turn, causes a more intense suction action, as a result of which more air is drawn out of the air reservoir.

Other features that are considered as characteristic for the invention are set forth in the appended claims.

Although the invention is illustrated and described herein as embodied in a sheet-fed offset printing process and a sheet-fed offset printing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
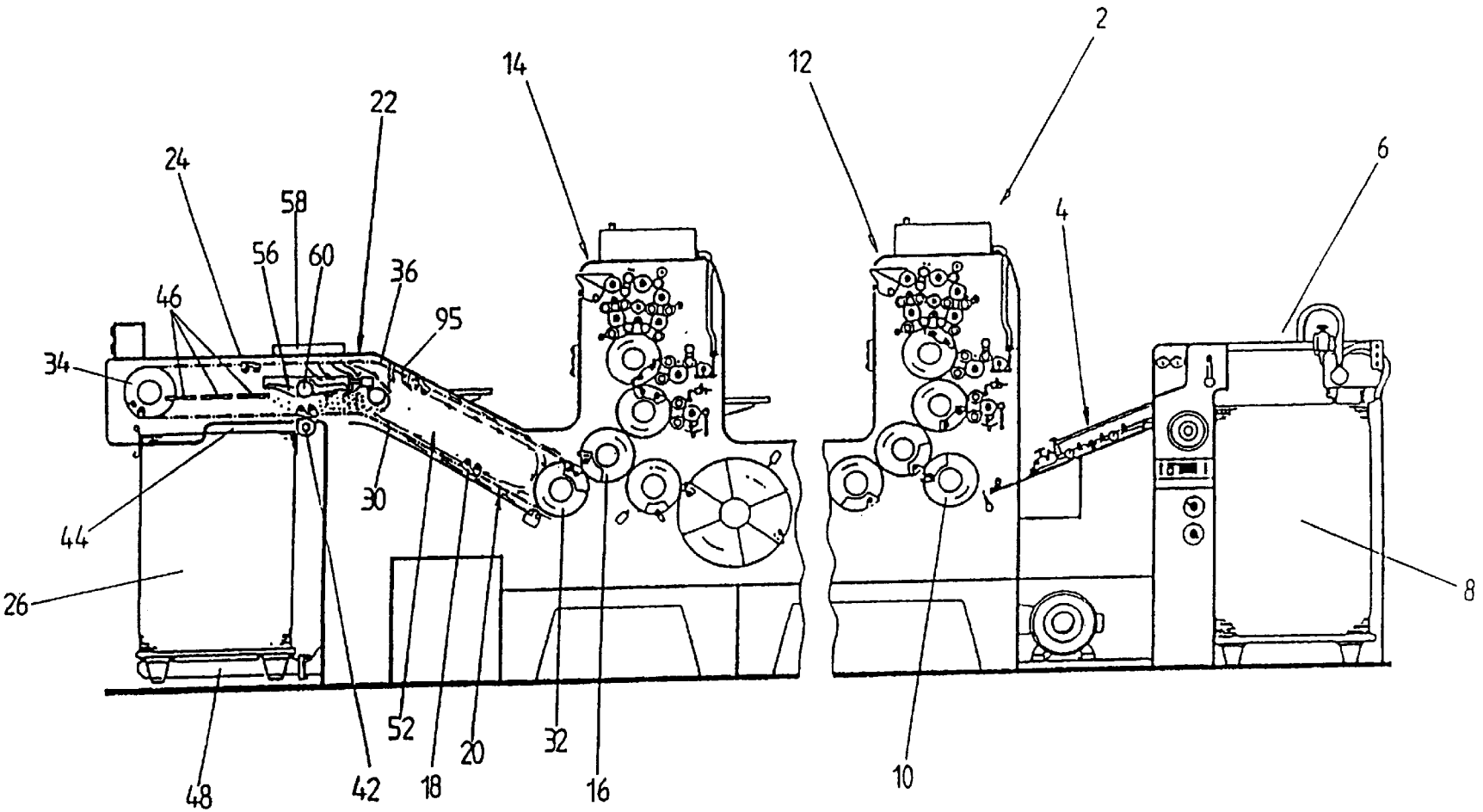
FIG. 1 is a fragmentary, cross-sectional view of a sheet-fed offset printing machine according to the invention.

In all the figures of the drawing, sub-features and integral parts that correspond to one another bear the same reference symbol in each case.

Referring now to the figures of the drawings in detail and first, particularly to FIG. 1 thereof, there is shown, partly and schematically, an eight-color sheet-fed offset printing machine 2. Therein, paper sheets are transferred one after another, by an automated sheet feed 4, from a paper stack 8 disposed in a sheet feeder 6 of the printing machine 2 to a feed drum 10 of a first printing unit 12, and are then transported through the first printing unit 12 and possibly further units of the total of eight printing units (only two of which are illustrated) to print them with one or more colors on one or both sides.

From an impression cylinder 16 of the last printing unit 14, delivery gripper systems 18 of a chain delivery 20 of a sheet delivery 22 of the printing machine 2 accept the printed sheets and transport them through a housing 24 of the sheet delivery 22 until above a sheet delivery stack 26. The sheets are then deposited one above another on the sheet delivery stack 26. The chain delivery 20 substantially includes two parallel non-illustrated chains guided in opposite lateral guide rails, which are connected at regular intervals by the gripper systems 18, also referred to as sheet grippers. The chain delivery 20 has a lower conveying run (system running forward) that transports the sheets and moves obliquely upward from the two chain wheels of a delivery drum 32. The chain delivery 20 is then deflected into the horizontal before it reaches two drive sprockets 34 at the free end of the sheet delivery 22. The upper empty run 36 (system running back) of the chain delivery 20 moves from the chain wheels 34 horizontally in the direction of the printing machine 2, before it is deflected obliquely downward and guided back to the delivery drum 32.

After being transferred to the sheet grippers 18, each sheet is guided by sheet guide plates 38 (see FIG. 2) in the direction of motion of the conveying run 30, past laterally adjustable guide-plate blowers 40 without contact and over a sheet brake 42 disposed downstream of the guide-plate blowers 40, and then reaches a sheet outlet opening 44 on the underside of the horizontal portion of the housing 24 of the sheet delivery 22. There, the sheets transferred to the sheet brake 42 by the grippers 18 and braked are blown downward onto the sheet delivery stack 26 with the aid of a number of delivery fans 46 disposed above the outlet opening 44. The stack 26 rests on a lifting mechanism 48 that lowers the stack 26 synchronously with the speed of the sheet feed.

In the vicinity of the upper end of the oblique portion of the chain conveyor 20, shortly upstream of the deflection of the conveying run 30 into the horizontal, a powdering apparatus 50 is disposed above the portion in the interspace 52 between the conveying run 30 and the empty run 36. The powdering apparatus 52 powders the top of the sheets, moist from printing and held by the sheet grippers 18 of the conveying run 30, with a finely powdered starch powder to prevent the sheets from sticking together (set-off) when they are subsequently stacked one above another. The powdering apparatus 50 substantially includes a pipe that extends through the interspace 52, transversely with respect to the direction of motion of the chain conveyor 20, and has a number of powder outlet slots on its underside. The starch powder is fed in with a non-illustrated blower connected to the pipe 54. The metering of powder depends on the size and color intensity of the printed areas.

The air flow is interrupted in the upper horizontal portion of the sheet delivery 22 to prevent powder from being entrained by the suction of the chain conveyor 20 and from being transported in the direction of the printing machine 2 by an air flow generated above and below its empty run 36 within the housing 24 of the sheet delivery 22, and at the same time to clean the chains and sheet grippers 18 of the chain delivery 20, dusted with powder.

Approximately above a drive shaft 60 of the lifting mechanism 48, that is to say downstream of the powdering apparatus 50 in the direction of motion of the conveying run 30, two rows of brushes 76, 92 are provided. The two rows of brushes 76, 92 extend over the entire clear width of the sheet delivery and project into the movement path of the empty run 36 from above and from below. The ends of the bristles of the brushes 76, 92 respectively bend over as the gripper systems 18 pass through. Accordingly, the gripper systems 18 can pass the brushes 76, 92 but at the same time prevent the formation of an air flow that runs along the empty run in the direction of the printing machine and with which powder can get from the front part of the delivery 22 back into the vicinity of the impression cylinder 16 or the delivery drum 32. In addition, disposed above the empty run 36 is a nozzle box 58 that, on its underside, is provided with air outlet nozzles, through which powder-free air is blown into the housing 24 from above. Disposed underneath the nozzle box 58 is a combined air extraction and deflection trough 56 in the interspace 52 between the conveying run 30 and the empty run 36. The trough 56 serves to extract part of the air blown in together with the powder cleaned off the empty run and to deflect the rest of the air in the direction of the printing machine.

As a result of the combined blowing-in and extraction of air, an air stream or air curtain is produced that passes through the flow path of the empty run 36 transversely with respect to its direction of motion and, together with the brushes 76, 92, interrupts the powder-laden air flow running along the empty run 36.

Figure 3:
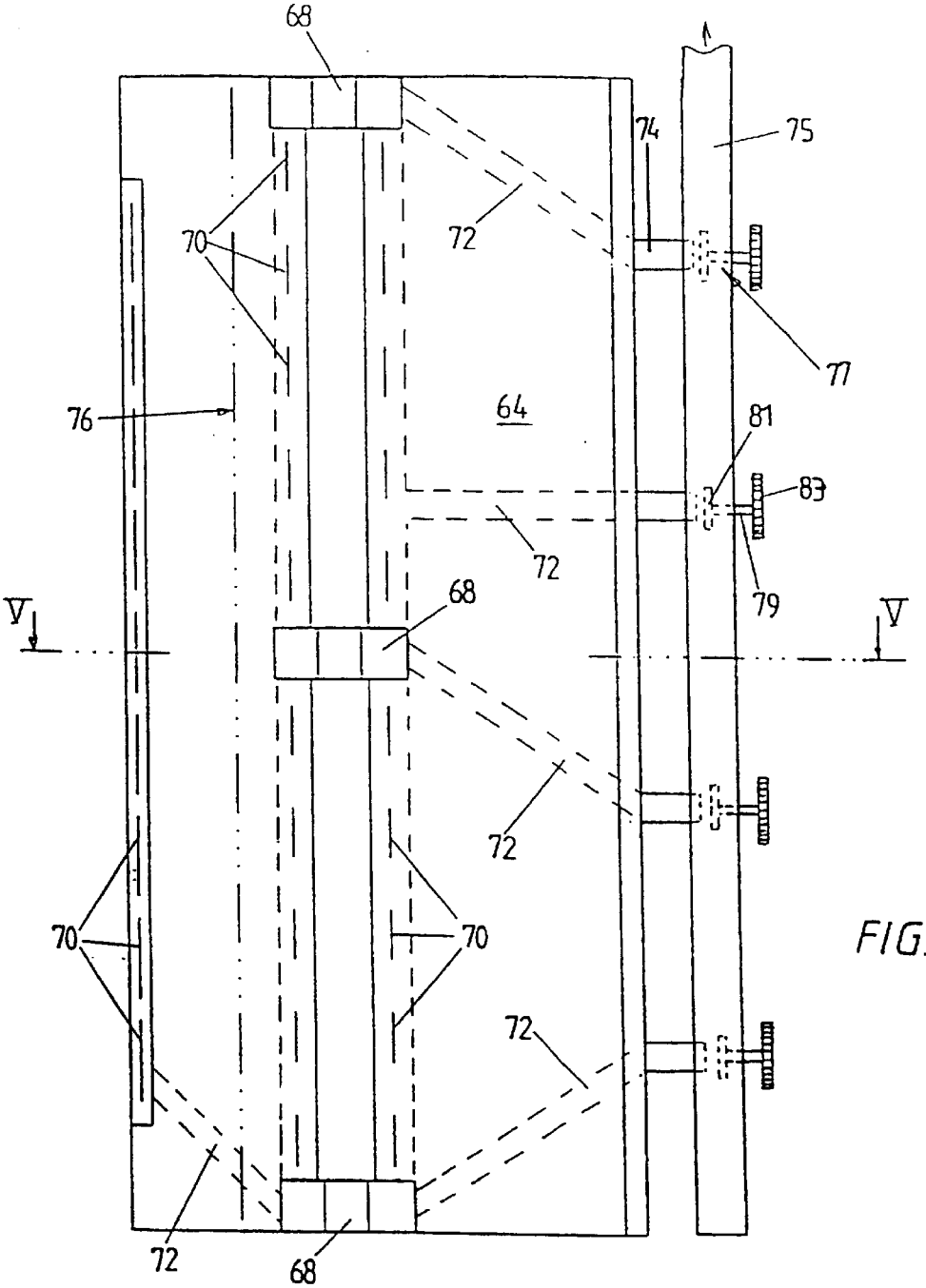
FIG. 3 is a plan view of an air extraction and deflection trough shown in FIG. 2.
Figure 4:
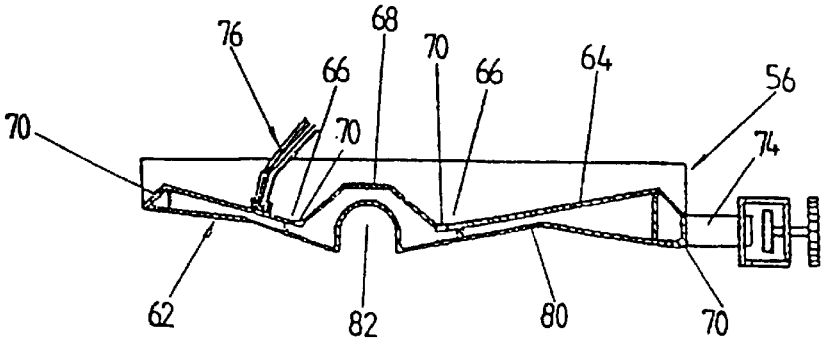
FIG. 4 is a cross-sectional view of the air extraction and deflection trough shown in FIG. 4 along the line V–V.

As best illustrated in FIGS. 3 and 4, the air extraction and deflection trough 56 substantially includes a thin-walled flat housing 62. The housing 62 extends underneath the lateral guides of the empty run 36, over the entire clear width of the chain delivery 20, and forms a continuous closed dividing wall between a flow path along the conveying run 30 and a flow path along the empty run 36. The housing 62 has an upper housing wall 64 bent over many times in the direction of motion of the chain conveyor 20, so that two flat hollows 66 are formed that are separated from each other by an elevation 68 disposed between them. The upper housing wall 64 is also provided with rows of powder extraction slots 70 disposed at intervals from one another. While adjacent central rows of extraction slots 70 are respectively located at the deepest parts of the hollows 66, outer rows are disposed in the immediate vicinity of the opposite outer edges of the housing 62. Of the rows of powder extraction slots 70, the slots 70 aligned obliquely downward on the outer edge facing the printing machine have the most intense vacuum applied to them. Each of the rows of slots is connected, by a suction channel 72 disposed inside the housing 62, to one of four suction nozzles 74 that project beyond the edge of the trough 56 on the printing-machine side.

The suction nozzles 74 open into an air extraction pipe 75 that is connected to a non-illustrated suction blower through a dust separator with a cyclone and fine filter. To control the amount of air extracted from each suction nozzle 74, adjustable flow control valves 77 are disposed upstream of the points where each suction nozzle 74 opens into the air extraction pipe 75. The valves 77 substantially include a threaded rod 79 that passes through a threaded hole in the wall of the air extraction pipe 75 and, at its inner and outer end, is provided with a disk-like plate 81 and an adjusting wheel 83 that rotates positively with the plate 81.

Therefore, by rotating the adjusting wheel 83, the distance between the plate 81 and that end of the adjacent suction nozzle 74 that projects inward into the air extraction pipe can be altered. Accordingly, the flow cross section of the air flow can be altered.

Also fitted to the top of the upper housing wall 64 is one 76 of the two cleaning brushes 76, 92. The brush 76 is located in that hollow 66 over which the empty run 36 of the chain delivery 20 sweeps first as it passes over the housing 62.

The housing 62 also has a lower housing wall 80 that, between the two hollows 66 and underneath the elevation 68 of the upper housing wall 64, is provided with a bulge 82 that is deepened upward and whose cross section has the shape of an inverted U. In the region of the bulge 82, the housing wall 80 encloses the drive shaft 60 that is disposed between the empty run 36 and the conveying run 30, that runs transversely, and whose upper side carries the housing 62. To reduce the friction between the slowly running drive shaft 60 and the lower housing wall 80, the lower housing wall 80 is provided with a Teflon coating in the region of the bulge 82.

Thus, the air extraction and deflection trough 56 is supported on the drive shaft 60 so that it has to be fixed to opposite side cheeks of the chain delivery 20 only by a few fixing screws to keep the trough 56 in position.

The nozzle box 58 serving as an air feed device includes a flat metal housing that, on its flat underside facing the empty run 36, is provided with a large number of air outlet nozzles, through which the sheet grippers 18 of the chain conveyor 20, passing through under the nozzle box 58, can be showered with air. The brush 92 is also fitted on the underside, immediately downstream of the brush 76 of the air extraction and deflection trough 56 in the direction of motion of the empty run 36.

The nozzle box 58 is connected through a non-illustrated air line and through an interposed, controllable throttle valve 102 (see FIG. 2), to a compressor 108 that takes in atmospheric air from the surroundings of the printing machine 2 and compresses it to a pressure between 1.5 and 3.5 bar. Connected in between the compressor 108 and the nozzle box 58 is a particle filter 110 for making the air fed into the nozzle box 58 dust-free.

Preferably, the amount of air fed into the nozzle box 58 is between 30 and 50 $m^3/h$ and is dimensioned such that only part is taken in through the powder extraction slots 70 of the air extraction and deflection trough 56, while the remaining air is deflected in the direction of the printing machine 2 at the top of the air extraction and deflection trough 56.

During operation of the printing machine 2 and of the sheet delivery 22, the air is fed in at a relatively low pressure of 1.5 to 2 bar. If there is downstream cleaning of the sheet delivery 22, the air pressure is increased to 3 to 3.5 bar. The controllable throttle valve 102 in the air line permits the cyclic feed of air into the nozzle box 58.

The air blown downward from the nozzle box 58 flows past the sheet grippers 18 and the chains of the chain conveyor 20 and entrains the adhering powder particles showered off by the air being downward so that the particles cannot be transported further in the direction of the printing machine 2 by the empty run 36. Moreover, as a result of being showered with air, the chains and guide rails 28 of the chain delivery 20 remain clean and saturated with grease to substantially prevent wear caused by powder. At the same time, the air stream guided downward, together with the two brushes 76, 92, forms a barrier on the underside in the region of the sheet delivery 22 between the closed housing cover on the top, the side walls of the sheet delivery 22, and the air extraction and deflection trough 56. The barrier prevents the powder-laden air from flowing along the empty run 36 in the direction of the printing machine 2.

While some of the air fed in is extracted with the cleaned-off powder particles through the powder extraction slots 70 of the two central rows of slots on the top of the air extraction and deflection trough 56, and the associated suction channels 72, and is cleaned in the dust separator connected downstream, the remaining air at the top of the trough 56 is deflected in the direction of motion of the empty run 36. At the same time, as a result of the air extraction at the rear outer edge of the trough 56, some of the air is deflected downward and flows downward, partly into the air extraction slots 70 disposed there and partly on the front side of the powdering apparatus 50, facing away from the printing machine. Another part of the deflected air is guided past above the powdering apparatus 50 in the direction of the printing machine 2 by the suction of the empty run 36.

Figure 2:
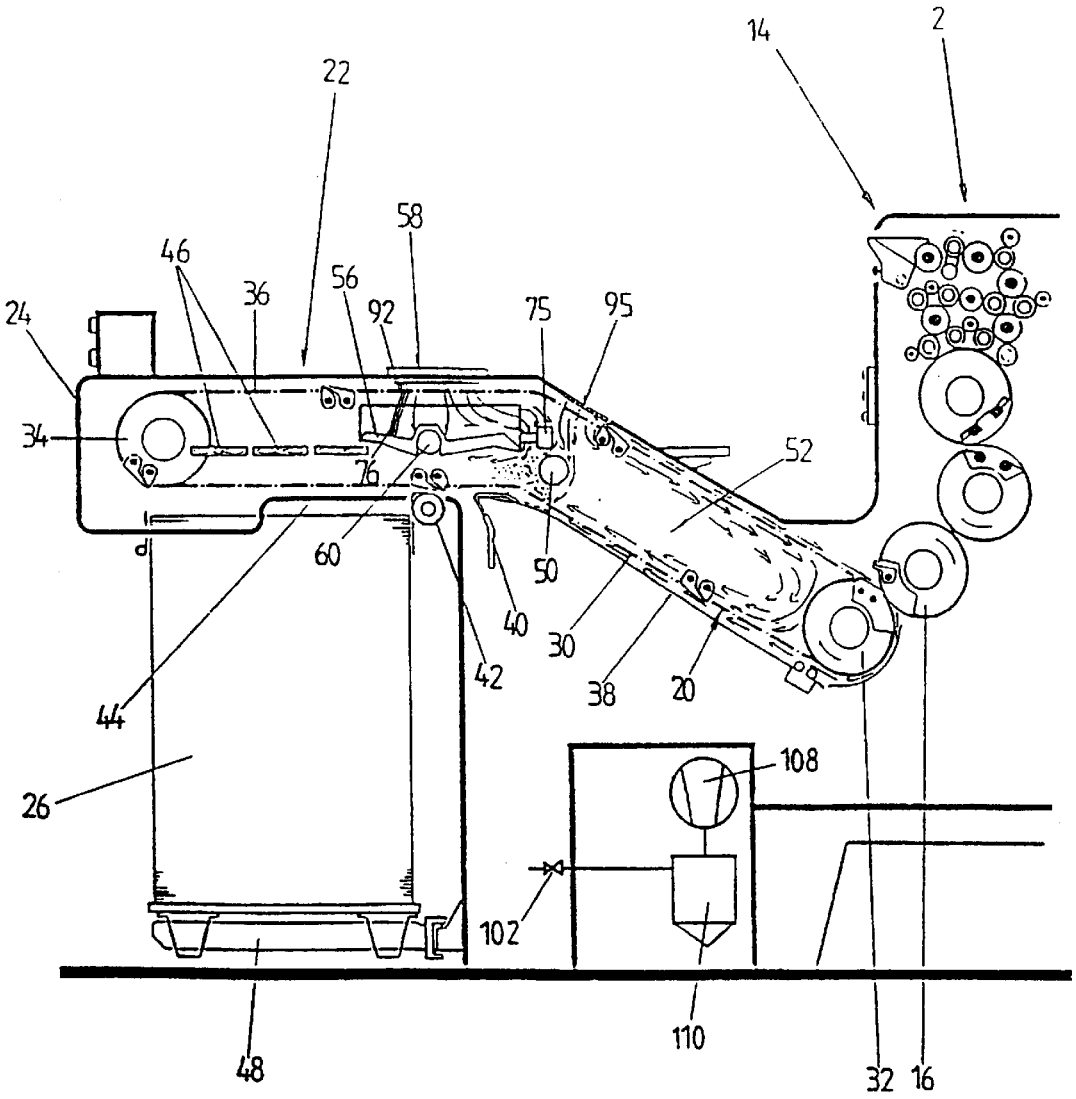
FIG. 2 shows an enlarged, fragmentary, cross-sectional view of the sheet delivery of the printing machine shown in FIG. 1.

At the same time, as a result of interrupting the air flow along the empty run 36, a vacuum is generated on the printing-machine side of the brushes 76, 92. The intensity of the vacuum depends on the amount of air fed in through the nozzle box 58. If relatively little air is fed in through the nozzle box 58, and the vacuum is accordingly higher, air is drawn into the interior of the housing 24 from the surroundings of the sheet delivery through a ventilation grille 95 disposed at the upper end of the oblique portion of the housing 24, as shown in FIG. 2. The major part of the air is entrained along the empty run 36 by the suction action of the same in the direction of the printing machine 2, while a smaller part flows downward past the air extraction pipe 75 acting as an air diverter and along the rear side of the powdering apparatus 50 pointing in the direction of the printing machine. These air flows, formed above and on both sides of the powdering apparatus 50, contribute to conveying the powder downward toward the surface of the sheets transported past and to preventing any swirling and spread of swirled powder.

Figure 5:
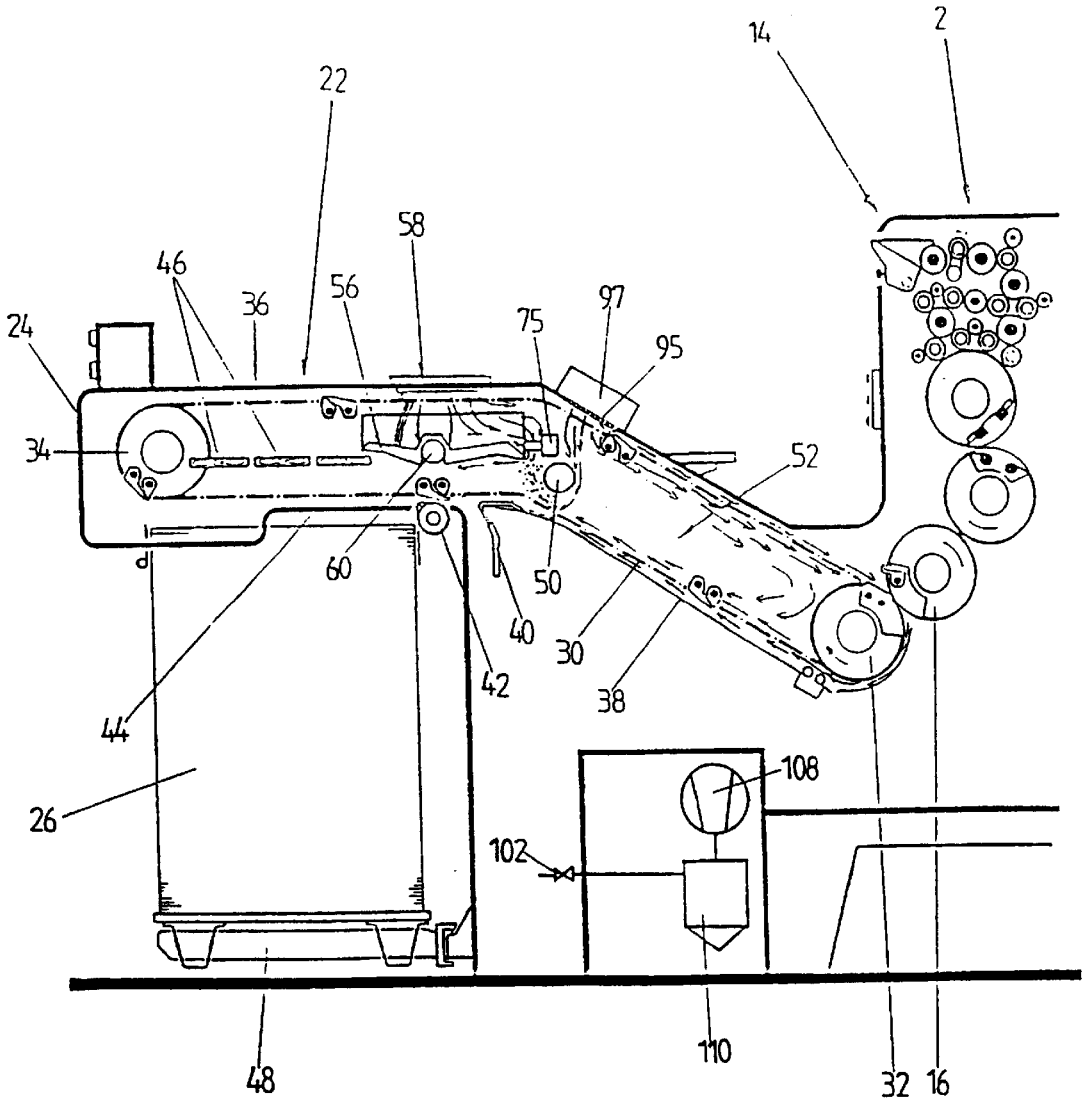
FIG. 5 is an enlarged, fragmentary, cross-sectional view of an alternative embodiment of the sheet delivery shown in FIG. 2.

In contrast to the sheet delivery 22 shown in FIG. 2, in the sheet delivery 22 shown in FIG. 5, an air reservoir 97 is disposed on the top of the sheet delivery 22, above the ventilation grille 95. Clean air, i.e., air not laden with powder, is fed from the particle filter 110 to the air reservoir 97, and is then drawn through the ventilation grille 95 instead of surrounding air. The air in the air reservoir 97 is preferably kept under atmospheric pressure so that more or less dried air is fed into the interior of the housing 24 as a function of the level of the vacuum generated by the empty run 36 of the sheet delivery 20. As such, simple, printing-speed-dependent control of the air feed can be achieved because the level of the vacuum increases with the running speed of the sheet delivery 20.

Figure 6:
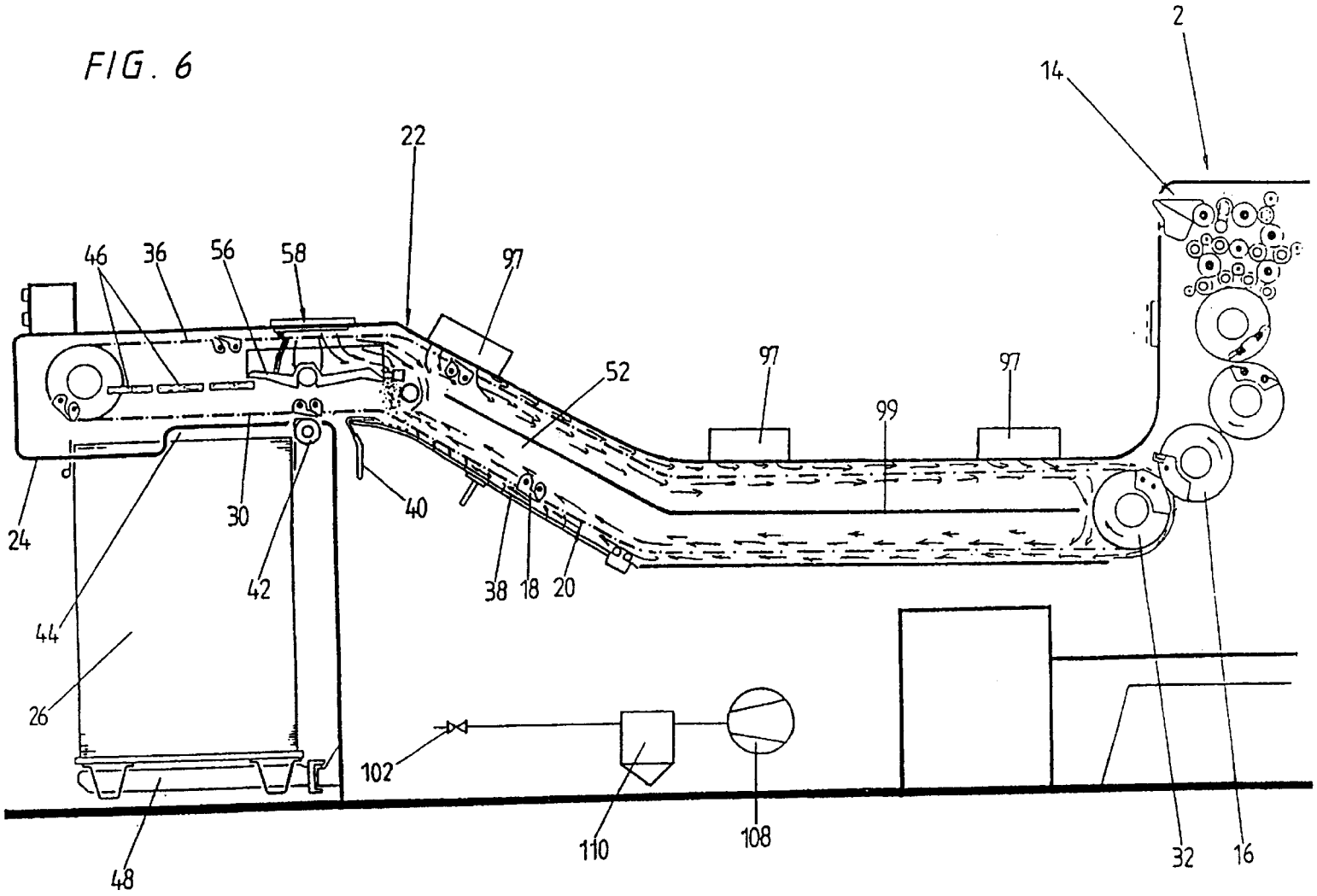
FIG. 6 is an enlarged, fragmentary, cross-sectional view of another alternative embodiment of the sheet delivery shown in FIG. 2.

In the lengthened sheet delivery 22 illustrated in FIG. 6, in its lower horizontal portion at two points, a further air reservoir 97 is respectively connected to the particle filter 110 disposed over a ventilation grille in the top of the housing to ensure that the powder-free air is transported as far as the delivery drum 32 and to the impression cylinder 16 of the printing machine 2.

Alternatively or additionally, between the empty run 36 and the conveying run 30 of the sheet delivery, a dividing wall 99 parallel to the chain conveyor 20 can be disposed. The dividing wall 99 prevents any reversal of the air flow before it reaches the printing machine 2 and prevents the production of powder-laden transverse flows upward out of the region of the conveying run into the flow path of the empty run 36. The dividing wall 99 can extend as far as the rear outer edge of the trough 56 even outside the powdering apparatus 50 to prevent the entry of powder into the blown-in or extracted, clean air and, therefore, into the flow path of the empty run 36. On the side of the printing machine 2, the dividing wall 99 stretches virtually as far as the delivery drum 32.

Figure 7:
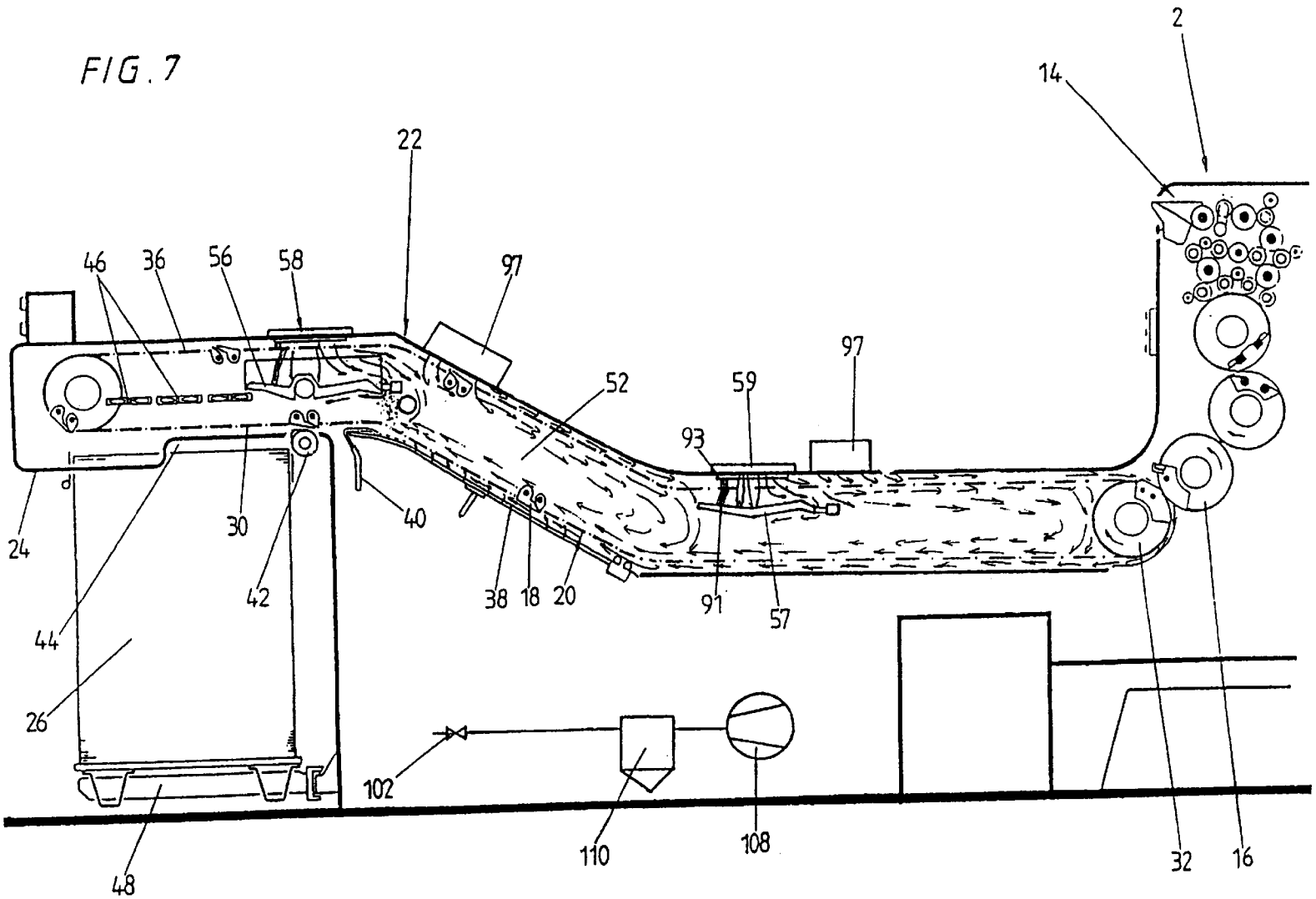
FIG. 7 is an enlarged, fragmentary, cross-sectional view of a further alternative embodiment of the sheet delivery shown in FIG. 2.

In addition to an air reservoir 97 disposed in its lower horizontal portion and connected to the interior of the housing by air openings, the lengthened sheet delivery 22 shown in FIG. 7 also has, upstream of the air reservoir 97 in the direction of motion of the empty run 36, a further nozzle box 59 and an air extraction and air deflection trough 57 that is disposed underneath the nozzle box 58 and between the empty run 36 and the conveying run 30. The trough 57 and box 58 have a function and construction, including two brush configurations 91, 93, substantially corresponding to that of the nozzle box 58 and of the air extraction and deflection trough 56. However, preferably, the trough 57 is somewhat flatter than the trough 58 and is carried by the side cheeks of the sheet delivery 20. In the case of still longer sheet deliveries 22, two such combinations of trough 57, nozzle box 59, and air reservoir 97 can further be provided.

At each point at which such a combination of trough 57, nozzle box 59, and air reservoir 97 is disposed, the air flow along the empty run 36 is interrupted or deflected downward toward the conveying run 30, as shown in FIG. 7. Some of the air blown in through the nozzle box 59 and the air extracted from the air reservoir 97, which are conveyed in the direction of the printing machine 2 by the suction action of the empty run 36, take the place of the interrupted air flow.

The air blown in by the nozzle box or boxes 58, 59, and the air drawn in from the air reservoir or reservoirs 97 and transported along the empty run 36 of the sheet delivery 20 to the delivery drum 32 by the suction action of the empty run 36, forms an air cushion above and below the sheets, which contributes to quieting the sheet run. The air cushion generated on the underside of the sheets can be supplemented and intensified by feeding in air from the sheet guide plates 38.

I claim:

1. A sheet-fed offset printing process, which comprises:

altering flow relationships in an interior of a housing of a sheet delivery of a sheet-fed printing machine to prevent uncontrolled spread of powder in the housing by: at least one of:

extracting powder-laden air from the housing on at least one point along an empty run of a sheet conveying device; and feeding air into the housing from outside the housing on at least one point along the empty run;

channeling air flows inside the housing by feeding air not laden with powder into the housing and leading the air not laden with powder into an air flow path along the empty run downstream of the at least one point with respect to a direction of motion of the empty run to transport the air not laden with powder in a direction toward a printing unit of the printing machine by at least one of:

a suction effect of the empty run; and at least impeding an inflow of powder-laden air from a region of at least one of a conveying run of the sheet conveying device and a powdering device into the flow path along the empty run.

2. The process according to claim 1, which further comprises feeding in the air not laden with powder from above the empty run into the air flow path along the empty run.

3. The process according to claim 1, which further comprises controlling an amount of air fed into the housing by at least one of a printing speed of the printing machine and a running speed of the sheet conveying device.

4. The process according to claim 1, which further comprises:

providing at least some of the air fed into the housing at atmospheric pressure; and drawing the air into the housing with a vacuum generated in the housing.

5. The process according to claim 4, wherein the providing step is performed by providing the air from an air reservoir disposed on a top side of the housing.

6. The process according to claim 1, which further comprises blocking the inflow of powder-laden air from the region of at least one of the conveying run and the powdering device into a flow path of the empty run by deflecting at least some of the air fed in through the air flow path along the empty run in a downward direction past a side of the powdering device facing the printing machine towards sheets transported by the conveying run past the powdering device.

7. The process according to claim 1, which further comprises feeding cleaned surrounding air into the housing of the sheet delivery.

8. The process according to claim 1, which further comprises interrupting the air flow path running along the empty run of the sheet conveying device in the direction toward the printing unit by at least one of extracting the powder-laden air and feeding air into the housing from outside on at least one point between a free end of the housing and the printing unit.

9. The process according to claim 8, wherein the interrupting step is performed by interrupting the air flow path by at least one of:

at least one row of brushes; and air flowing transversely with respect to the direction of motion of the empty run.

10. The process according to claim 1, which further comprises extracting at least one of the powder-laden air and the air not laden with powder fed into the housing from outside in a horizontal portion at a top side of the sheet delivery.

11. The process according to claim 1, which further comprises blocking the inflow of powder-laden air from the region of at least one of the conveying run of the sheet conveying device and the powdering device into a movement path of the empty run with a dividing wall disposed between the empty run and the conveying run.

12. A sheet-fed offset printing machine for printing sheets, comprising:

at least one printing unit;

a sheet conveying device having an empty run and a conveying run, said empty run having a motion direction, said sheet conveying device connected to said at least one printing unit;

a sheet delivery having a housing defining an interior, said sheet delivery connected to said sheet conveying device;

a powdering device disposed in said housing for powdering printed sheets;

at least one of:

air feed devices feeding air into said housing from outside said housing and disposed on at least one point along said empty run to prevent an uncontrolled spread of powder in said housing by altering flow relationships inside said housing; and air extraction devices for extracting powder-laden air from said housing and disposed on at least one point along said empty run to prevent an uncontrolled spread of powder in said housing by altering flow relationships inside said housing; and channeling devices at least one of:

leading air not laden with powder, fed into said interior of said housing downstream of said at least one of said air extraction devices and said air feed devices in said motion direction, into an air flow path along said empty run to transport the air not laden with powder in a direction of said at least one printing unit by suction; and at least impeding an inflow of powder-laden air from a region of at least one of said conveying run and said powdering device into an air glow path along said empty run.

13. The sheet-fed offset printing machine according to claim 12, wherein said channeling devices include at least one air opening in said housing.

14. The sheet-fed offset printing machine according to claim 13, wherein:

said housing has a top side; and said at least one air opening is disposed on said top side of said housing above said empty run.

15. The sheet-fed offset printing machine according to claim 13, including a delivery drum connected to said sheet conveying device, said at least one air opening being disposed between said delivery drum and said at least one of said air extraction devices and said air feed devices.

16. The sheet-fed offset printing machine according to claim 13, wherein air fed in through said at least one air opening is at atmospheric pressure.

17. The sheet-fed offset printing machine according to claim 13, wherein said powdering device has a side facing said at least one printing unit and another side facing away from said at least one printing unit, and an air diverter is disposed under said at least one air opening dividing air fed into said housing from outside said housing into two partial-flows, a first of said two partial-flows directed along said side of said powdering device facing said at least one printing unit and a second of said two partial-flows directed along said another side facing away from said at least one printing unit in a direction of sheets passing underneath said powdering device.

18. The sheet-fed offset printing machine according to claim 13, wherein an amount of air fed into said housing is to be controlled by altering one of a printing speed of the printing machine and a running speed of said sheet conveying device.

19. The sheet-fed offset printing machine according to claim 13, wherein said at least one air opening at least one of opens into said housing in a vicinity of said empty run and communicates with said interior of said housing.

20. The sheet-fed offset printing machine according to claim 12, wherein said channeling devices include at least one air reservoir communicating with said interior of said housing.

21. The sheet-fed offset printing machine according to claim 20, wherein said at least one air reservoir at least one of opens into said housing in a vicinity of said empty run and communicates with said interior of said housing.

22. The sheet-fed offset printing machine according to claim 20, wherein:

said housing has a top side; and said at least one air reservoir is disposed on said top side of said housing above said empty run.

23. The sheet-fed offset printing machine according to claim 20, including a delivery drum connected to said sheet conveying device, said at least one air reservoir being disposed between said delivery drum and said at least one of said air extraction devices and said air feed devices.

24. The sheet-fed offset printing machine according to claim 20, wherein air fed in through said at least one air reservoir is at atmospheric pressure.

25. The sheet-fed offset printing machine according to claim 20, wherein said powdering device has a side facing said at least one printing unit and another side facing away from said at least one printing unit, and an air diverter is disposed under said at least one reservoir dividing air fed into said housing from outside said housing into two partial-flows, a first of said two partial-flows directed along said side of said powdering device facing said at least one printing unit and a second of said two partial-flows directed along said another side facing away from said at least one printing unit in a direction of sheets passing underneath said powdering device.

26. The sheet-fed offset printing machine according to claim 20, wherein an amount of air fed into said housing is to be controlled by altering one of a printing speed of the printing machine and a running speed of said sheet conveying device.

27. The sheet-fed offset printing machine according to claim 12, including air cleaning devices for cleaning air fed into said housing.

28. The sheet-fed offset printing machine according to claim 12, wherein:

said sheet delivery has a length; and said channeling devices include a dividing wall disposed over a part of said length between said empty run and said conveying run.

29. The sheet-fed offset printing machine according to claim 28, wherein said dividing wall extends into a vicinity of said at least one printing unit.

30. The sheet-fed offset printing machine according to claim 28, wherein said dividing wall extends from said at least one of said air feed devices and said air extraction devices into a vicinity of said at least one printing unit.

31. The sheet-fed offset printing machine according to claim 12, wherein:

said sheet delivery has an upper horizontal portion; and some of said at least one of said air feed devices and said air extraction devices are disposed in said upper horizontal portion.

32. The sheet-fed offset printing machine according to claim 12, wherein said at least one of said air feed devices and said air extraction devices produce an air flow passing through said empty run transversely with respect to said motion direction of said empty run to interrupt a powder-laden air flow running along said empty run in a direction towards said at least one printing unit.

33. The sheet-fed offset printing machine according to claim 12, including at least one brush configuration at least partly blocking said air flow path along said empty run.

34. A sheet-fed offset printing process, which comprises:

altering flow relationships in an interior of a housing of a sheet delivery of a sheet-fed printing machine to prevent uncontrolled spread of powder in the housing by:

moving air at a point along an empty run of a sheet conveying device; and channeling air flows inside the housing by feeding air not laden with powder into the housing and leading the air not laden with powder into an air flow path along the empty run downstream of the point with respect to a direction of motion of the empty run to transport the air not laden with powder in a direction toward a printing unit of the printing machine.

35. The process according to claim 34, which further comprises performing the moving air step by extracting powder-laden air from the housing at the point along an empty run of a sheet conveying device.

36. The process according to claim 34, which further comprises performing the moving air step by feeding air into the housing from outside the housing at the point along the empty run.

37. The process according to claim 34, which further comprises performing the moving air step by:

extracting powder-laden air from the housing at the point along an empty run of a sheet conveying device; and feeding air into the housing from outside the housing at another point along the empty run.

38. The process according to claim 34, which further comprises performing the channeling step by transporting the air not laden with powder by a suction effect of the empty run.

39. The process according to claim 34, which further comprises performing the channeling step by transporting the air not laden with powder by at least impeding an inflow of powder-laden air from a region of at least one of a conveying run of the sheet conveying device and a powdering device into the flow path along the empty run.

40. The process according to claim 34, which further comprises performing the channeling step by transporting the air not laden with powder by:

a suction effect of the empty run; and at least impeding an inflow of powder-laden air from a region of at least one of a conveying run of the sheet conveying device and a powdering device into the flow path along the empty run.

41. A sheet-fed offset printing machine for printing sheets, comprising:

at least one printing unit;

a sheet conveying device having an empty run and a conveying run, said empty run having a motion direction, said sheet conveying device connected to said at least one printing unit;

a sheet delivery having a housing defining an interior, said sheet delivery connected to said sheet conveying device;

a powdering device disposed in said housing for powdering printed sheets;

an air flow device disposed at a point along said empty run to prevent an uncontrolled spread of powder in said housing by altering flow relationships inside said housing a channeling device leading air not laden with powder, fed into said interior of said housing downstream of said air flow device in said motion direction, into an air flow path along said empty run to transport the air not laden with powder in a direction of said at least one printing unit by suction.

42. The sheet-fed offset printing machine according to claim 41, wherein said air flow device includes at least one air feed device feeding air into said housing from outside said housing.

43. The sheet-fed offset printing machine according to claim 41, wherein said air flow device includes at least one air extraction device for extracting powder-laden air from said housing.

44. The sheet-fed offset printing machine according to claim 41, wherein said air flow device includes:

at least one air feed device feeding air into said housing from outside said housing; and at least one air extraction device for extracting powder-laden air from said housing.

45. The sheet-fed offset printing machine according to claim 41, wherein said channeling device at least impedes an inflow of powder-laden air from a region of at least one of said conveying run and said powdering device into said air flow path along said empty run.

46. The sheet-fed offset printing machine according to claim 41, said channeling device leads air not laden with powder, fed into said interior of said housing downstream of said air flow devices in said motion direction, into an air flow path along said empty run to transport the air not laden with powder in a direction of said at least one printing unit by suction and at least impedes an inflow of powder-laden air from a region of at least one of said conveying run and said powdering device into said air flow path along said empty run.

* * * * *